US008245774B2

(12) United States Patent
Carter et al.

(10) Patent No.: US 8,245,774 B2
(45) Date of Patent: Aug. 21, 2012

(54) WHIPSTOCK ASSEMBLY FOR FORMING A WINDOW WITHIN A WELLBORE CASING

(75) Inventors: Thurman B. Carter, Houston, TX (US); Thomas M. Redlinger, Houston, TX (US); David J. Brunnert, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 146 days.

(21) Appl. No.: 12/099,659

(22) Filed: Apr. 8, 2008

(65) Prior Publication Data

US 2008/0185148 A1 Aug. 7, 2008

Related U.S. Application Data

(63) Continuation of application No. 10/510,672, filed as application No. PCT/US03/11455 on Apr. 14, 2003, now Pat. No. 7,353,867.

(60) Provisional application No. 60/372,004, filed on Apr. 12, 2002.

(51) Int. Cl.
*E21B 29/12* (2006.01)

(52) U.S. Cl. ..... 166/117.5; 166/255.3; 166/50; 166/341

(58) Field of Classification Search ..... 166/117.5, 166/298, 50, 255.2, 341, 255.3; 175/425
See application file for complete search history.

(56) References Cited

U.S. PATENT DOCUMENTS 2,338,788 A * 1/1944 Walker ..... 166/117.6
2,509,144 A * 5/1950 Grable et al. ..... 175/81
3,343,615 A * 9/1967 Terry ..... 175/406
4,266,621 A * 5/1981 Brock ..... 175/385
4,285,399 A * 8/1981 Holland et al. ..... 166/113
4,397,360 A * 8/1983 Schmidt ..... 175/61
5,113,938 A * 5/1992 Clayton ..... 166/117.6
5,277,251 A * 1/1994 Blount et al. ..... 166/117.5
5,341,873 A * 8/1994 Carter et al. ..... 166/117.5
5,353,876 A * 10/1994 Curington et al. ..... 166/313
5,425,419 A * 6/1995 Sieber ..... 166/206
5,437,340 A * 8/1995 Lee et al. ..... 175/61
5,445,222 A * 8/1995 Pritchard et al. ..... 116/298
5,488,989 A * 2/1996 Leising et al. ..... 166/255.3
5,531,271 A * 7/1996 Carter ..... 166/117.6
5,551,509 A * 9/1996 Braddick ..... 166/55.7

(Continued)

FOREIGN PATENT DOCUMENTS

WO WO 03087524 A1 * 10/2003

*Primary Examiner* — Thomas Beach
*Assistant Examiner* — Matthew Buck
(74) *Attorney, Agent, or Firm* — Patterson & Sheridan, LLP

(57) ABSTRACT

The present invention discloses a whipstock assembly for use in forming a lateral borehole from a parent wellbore. The whipstock assembly comprises a body and a deflection member above the body. The deflection member includes a concave portion for deflecting a milling bit during a milling operation. Disposed on a perforation plate portion of the concave portion is a raised surface feature. The raised surface supports a milling bit above the perforation plate portion during a milling operation. This, in turn, substantially prevents frictional contact between the milling bits and the perforation plate portion during a milling operation. The present invention also provides a novel method for manufacturing a whipstock in which a cavity portion is formed behind the perforation plate by milling out the backside of the deflection member and then joining a second back cover member to the whipstock body to complete the assembly.

36 Claims, 14 Drawing Sheets

U.S. PATENT DOCUMENTS 5,657,820 A * 8/1997 Bailey et al. ..... 166/55.7
5,769,166 A * 6/1998 Duke ..... 166/298
5,806,600 A * 9/1998 Halford, Sr. ..... 166/382
5,813,465 A * 9/1998 Terrell et al. ..... 166/298
5,887,655 A 3/1999 Haugen et al.
5,894,889 A * 4/1999 Dewey et al. ..... 166/298
6,012,516 A * 1/2000 Brunet ..... 166/50
6,019,173 A * 2/2000 Saurer et al. ..... 166/98
6,024,169 A * 2/2000 Haugen ..... 166/298
6,056,056 A * 5/2000 Durst et al. ..... 166/298
6,092,593 A * 7/2000 Williamson et al. ..... 166/50
6,092,601 A 7/2000 Gano et al.
6,125,937 A * 10/2000 Longbottom et al. ..... 166/313
6,138,756 A * 10/2000 Dale ..... 166/254.2
6,283,208 B1 * 9/2001 George et al. ..... 166/255.3
6,315,044 B1 * 11/2001 Tinker ..... 166/298
6,332,498 B1 * 12/2001 George ..... 166/50
6,457,525 B1 * 10/2002 Scott ..... 166/300
6,591,905 B2 * 7/2003 Coon ..... 166/117.6
6,708,769 B2 * 3/2004 Haugen et al. ..... 166/384
6,719,045 B2 * 4/2004 Hart et al. ..... 166/117.6
6,766,859 B2 * 7/2004 Haugen et al. ..... 166/313
6,968,896 B2 * 11/2005 Coon ..... 166/117.6
6,968,903 B2 * 11/2005 Pollard ..... 166/382
2002/0070018 A1 * 6/2002 Buyaert ..... 166/255.3
2002/0079102 A1 * 6/2002 Dewey et al. ..... 166/313
2003/0196819 A1 * 10/2003 Coon ..... 166/382
2005/0257930 A1 * 11/2005 Carter et al. ..... 166/298

* cited by examiner

--Prior Art-- FIG. 1
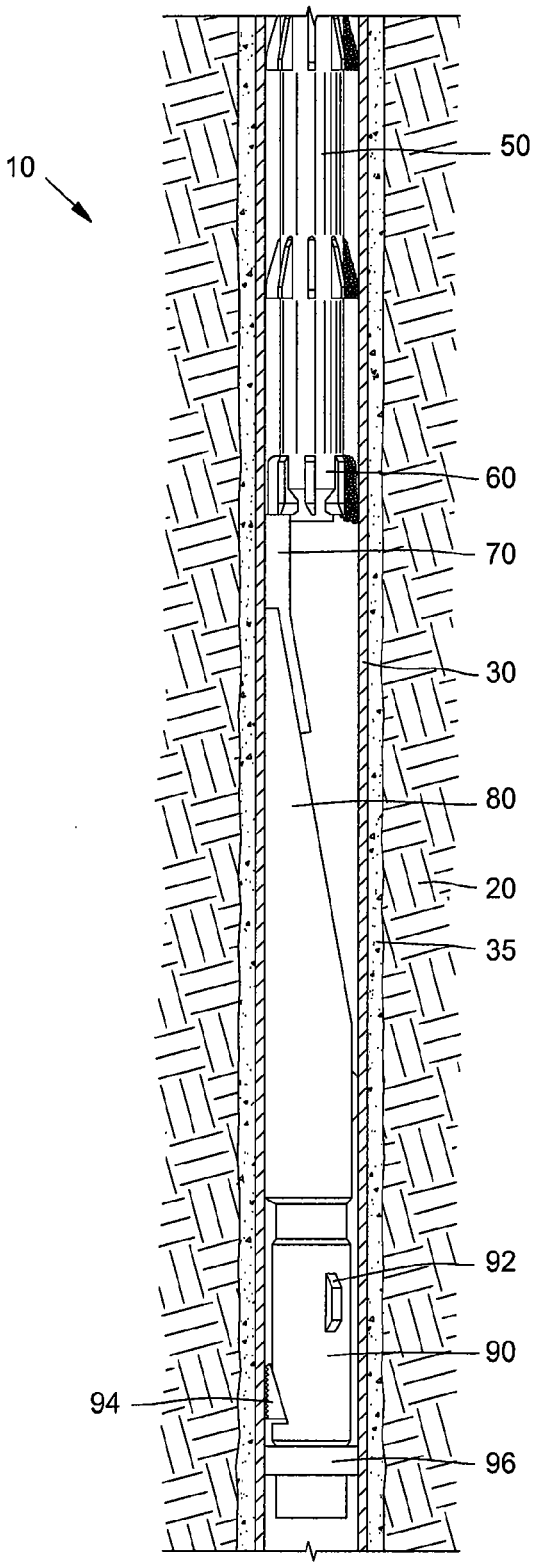
FIG. 2
--Prior Art--
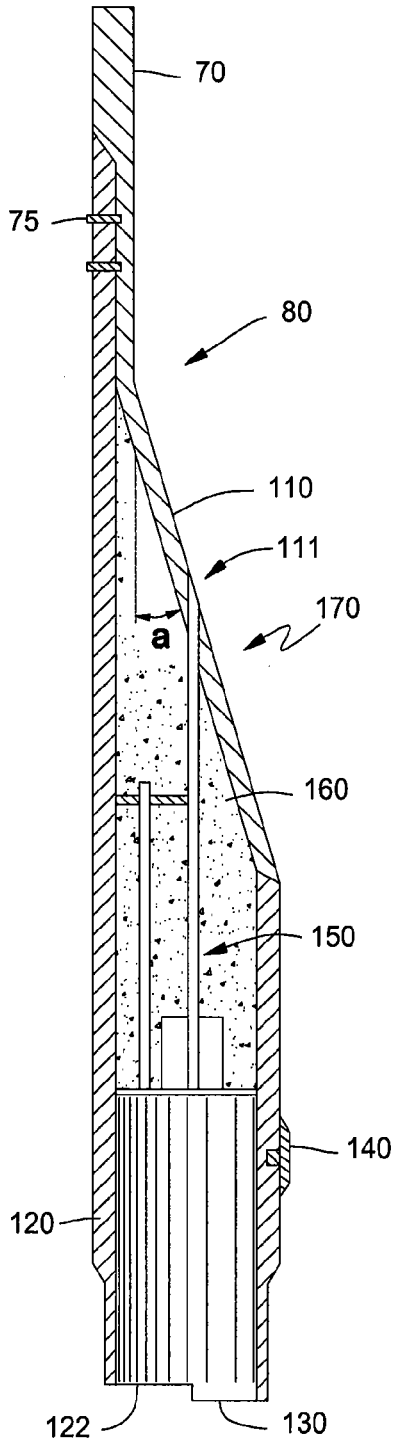

WHIPSTOCK ASSEMBLY FOR FORMING A WINDOW WITHIN A WELLBORE CASING

CROSS-REFERENCE TO RELATED APPLICATIONS

This application is a continuation of U.S. patent application Ser. No. 10/510,672, filed Aug. 23, 2005, now U.S. Pat. No. 7,353,867 which claims benefit of U.S. provisional patent application Ser. No. 60/372,004, filed Apr. 12, 2002. Each of the aforementioned related patent applications is herein incorporated by reference in its entirety.

BACKGROUND OF THE INVENTION

1. Field of the Invention

This invention is related to the practice of sidetrack drilling for hydrocarbons. More specifically, this invention pertains to a whipstock assembly for creating a window within a wellbore casing. More particularly still, the invention pertains to a whipstock that more easily permits penetration of perforation shots through the perforation plate.

2. Description of the Related Art

In recent years, technology has been developed which allows an operator to drill a primary vertical well, and then continue drilling an angled lateral borehole off of that vertical well at a chosen depth. Generally, the vertical, or "parent" wellbore is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

In many instances, the parent wellbore is completed at a first depth, and is produced for a given period of time. Production may be obtained from various zones by perforating the casing string. At a later time, it may be desirable to drill a new "sidetrack" wellbore utilizing the casing of the parent wellbore. In this instance, a tool known as a whipstock is positioned in the casing at the depth where deflection is desired, typically at or above one or more producing zones. The whipstock is specially configured to divert milling bits into a side of the casing in order create an elongated elliptical window in the parent casing. Thereafter, a drill bit is run into the parent wellbore. The drill bit is deflected against the whipstock, and urged through the newly formed window. From there, the drill bit contacts the rock formation in order to form a new lateral hole in a desired direction. This process is sometimes referred to as sidetrack drilling.

When forming the window through the casing, an anchor is first set in the parent wellbore at a desired depth. The anchor is typically a packer having slips and seals. The anchor tool acts as a fixed body against which tools above it may be urged to activate different tool functions. The anchor tool typically has a key or other orientation-indicating member. The anchor tool's orientation is checked by running a tool such as a gyroscope indicator or measuring-while-drilling device into the wellbore.

A whipstock is next run into the wellbore. The whipstock has a body that lands into or onto the anchor. A stinger is located at the bottom of the whipstock which engages the anchor device. In this respect, splined connections between the stinger and the anchor facilitate correct stinger orientation. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding tubular casing for cutting the window.

In order to form the window, a milling bit, or "mill," is placed at the end of a string of drill pipe or other working string. In one arrangement, the mill includes cutting blades that are spiraled in order to form water courses there between. An alloy of nickel and crushed carbide is typically placed at the tip of the mill for frictionally engaging the steel casing as the mill bit is rotated. In the usual milling operation, a series of mills is run into the hole. First, a starting mill is run into the hole. Rotation of the string with the starting mill rotates the mill, causing a portion of the casing to be removed. This mill is followed by other mills, which complete the creation of the elongated window.

FIG. 1 presents a cross-sectional view of a wellbore 10. As completed in FIG. 1, the wellbore 10 has a first string of surface casing (not shown) hung from the surface. The first string is fixed in a formation 20 by cured cement. A second string of casing 30 is also present in the completed wellbore 10. The second casing string 30, sometimes referred to as a "liner," is hung from the surface casing by a conventional liner hanger (not shown). The liner hanger employs slips which engage the inner surface of the surface casing to form a frictional connection. The liner 30 is also cemented into the wellbore 10 after being hung from the surface casing. A column of cured cement 35 is shown in FIG. 1 in the annular region between the liner 30 and the surrounding formation 20.

The wellbore 10 of FIG. 1 includes a working string 50 that is run into the hole. Attached to the working string 50 at the lower end is a mill 60. The mill 60 is shown somewhat schematically. It is understood that the initial mill 60, referred to as a "starter" mill, is more elongated and frequently employs more than one set of cutting blades, as will be described in connection with FIG. 3. Rotation of the working string 50 imparts rotary movement to the starter mill 60.

FIG. 1 also presents, somewhat schematically, a side view of a whipstock 80. The whipstock 80 is known in the art. A fuller, cross-sectional view of a prior art whipstock 80 is shown in FIG. 2. The whipstock 80 has a top end that is releasably connected to a pilot lug 70 by shear studs 75. The pilot lug 70 serves as a sacrificial element in the initial cutting of a window. It is understood that the pilot lug 70 is an optional feature, but is nevertheless commonly used.

The whipstock 80 has a body 120 that defines an outer metal shell and an inner cavity 150. The body 120 of the whipstock 80 has a bottom end 122 that lands upon an anchor. The anchor is shown at 90 in FIG. 1. It can be seen in FIG. 1 that the anchor 90 may be a packer having centralizers 92, slips 94, and a sealing element 96. The bottom end 122 of the whipstock 80 includes an orientation key 130. The orientation key 130 lands in the anchor 90 and aids in properly orienting the whipstock 80 downhole.

The whipstock 80 also comprises a deflection portion 170. The deflection portion 170 of the whipstock 80 is at the top end of the whipstock 80, and serves to urge the mill 60 outwardly against the surrounding tubular 30, e.g. casing, during a milling operation. The deflection portion 170 typically defines a concave-shaped portion of the body 120 that serves as a concave-shaped member 111. In the case of a perforation whipstock 80, the concave-shaped member 111 includes a plate referred to as a "perforation plate" 110. As will be set forth in detail below, the perforation plate 110 receives shaped charges (or other perforation explosives) during subsequent wellbore completion operations. In this manner, production may again be obtained from the primary wellbore. More specifically, the operator may produce fluids from the original formation through the anchor, the packer, and then through a cavity 160 within the whipstock body.

The cavity 160 in some whipstock arrangements is partially filled with cement, and with a bore optionally retained therethrough. More recent whipstock designs retain a hollow cavity 160. In this manner, the whipstock body serves as a pressure-retaining vessel until perforations are placed in the perforation plate 110. However, in prior art whipstock designs, the perforation plate 110 has a limited pressure capacity, i.e., burst pressure, because the perforation plate 110 simply represents a plate welded onto a formed ramp in the whipstock body. As will be discussed further below, a need has existed for a whipstock assembly having a greater burst pressure capacity.

As noted above, a mill 60 is run into the wellbore 10 in order to begin milling a window in the casing string 30. An exemplary starting mill 200 is shown in FIG. 3. The starting mill 200 has a body 202 with a fluid flow channel 204 therethrough (shown in dotted lines). Three sets of cutting blades 210, 220, and 230 with, respectively, a plurality of blades 211, 221, and 231 are spaced apart on the body 202. Jet ports 239 are in fluid communication with the channel 204.

The exemplary starting mill 200 has a tapered nose 240 that projects down from the body 202. The mill 200 also has a tapered end 241, a tapered ramped portion 242, a tapered portion 243, and a cylindrical portion 244. It is understood that the mill 200 in FIG. 3 is exemplary only; the present invention is not limited in scope by the type of starter mill employed, or the manner in which it is run into a wellbore 10.

The starter mill 200 is slowly lowered to contact the pilot lug 70 (or some sacrificial element) on the concave-shaped member 111 of the whipstock 80. The starter mill 200 moves downwardly while contacting the perforation plate 110 of the whipstock 80. This urges the starting mill 200 into contact with the casing 30. As the mill 200 initially moves down in the wellbore, the blades 230 begin to mill the pilot lug 70 and any other sacrificial element, e.g., nose 240. The pilot lug 70 and any other sacrificial element are chewed by the lower starter blades 230. As the starter mill 200 moves further downwardly, the lower blades 230 contact the perforation plate 110 of the whipstock 80. The angled geometry of the concave-shaped member 111 of the whipstock 80 urges the starter blades 230 outwardly into contact with the adjacent casing 30. These lowest blades 231 then begin milling into the casing 30 to form the initial window at the desired location. The casing 30 is milled as the pilot lug 70 is milled off.

Milling of the casing 30 is achieved by rotating the tool 200 against the inner wall of the casing 30 while at the same time exerting a downward force on the drill string 50 against the whipstock 100. After the mill 20 has moved downwardly to cause the lower blades 231 to begin milling the casing 30, the middle 221 and upper 211 blades also begin to mill portions of adjacent casing 30 above the lower blades 231. The upper blades 221, 211 are preferably configured to cut successively larger window portions. Ultimately, the starting mill 200 cuts an elongated initial window (not shown) in the casing 30. The starting mill 200 is then removed from the wellbore 10.

A window mill is next lowered into the wellbore 10. FIG. 4 presents an exemplary window mill 250 for use to enlarge the starting window made by the starter mill 200. The window mill 250 has a body 252 with a fluid flow channel 254 from top to bottom and jet ports 255 to assist in the removal of cuttings and debris. A plurality of blades 256 present a smooth finished surface 258 that move along what is left of the sacrificial element (e.g. one, two, three up to about twelve to fourteen inches) and then on the edges of the concave-shaped member 111. Lower ends of the blades 256 and even a lower portion of the body 252 are dressed with milling material 260, such as tungsten carbide chunks in a nickel alloy. The spacing between the cutting blades 256 is known as the watercourses. The watercourses permit the recirculation of fluids with suspended metal cuttings back up the wellbore 10 during the milling operation.

In one aspect, the lower end of the body 252 tapers inwardly at an angle "c" to inhibit the window mill lower end from directly contacting and milling the perforation plate 110 of the whipstock body 120. In this respect, the angle "c" is preferably greater than the angle "a" of the concave-shaped member 111, shown in FIG. 2. Preferably, the angle "a" of the whipstock 250 is three degrees. Therefore, the angle "c" for the lower ends of the blades 256 is greater than three degrees.

In one aspect, the surface 258 is about fourteen inches long and, when used with the mill 200 having blades 211, 221, 231 about two feet apart as described above, an opening of about five feet in length is formed in the casing 30 when the sacrificial element has been completely milled down. In this embodiment, the window mill 250 is then used to mill down another ten to fifteen feet so that a completed opening of fifteen to twenty feet is formed, which includes a window in the casing 30 of about eleven to fifteen feet and a milled bore into the formation adjacent the casing 30 of about five to nine feet.

The window mill 250 is lowered into the wellbore on a working string. An example is a flexible joint of drill pipe (not shown).

Additional information concerning the construction of window mills, in at least one embodiment, is found in U.S. Pat. No. 5,787,978, issued to Carter, et al. in 1998. The assignee of that patent is Weatherford/Lamb, Inc.

As a next step, the working string 50 is tripped. A drill bit 40 is then run on drill string 78 which is deflected by the whipstock 80 through the freshly milled window W. This stage of the milling operation is depicted in the view of FIG. 5. FIG. 5 presents a cross-sectional view of the wellbore 10 of FIG. 1, with a window W having been formed in the casing 30. A lateral borehole L is now being drilled, as shown by arrow 42. A drill bit 40 is shown at the end of a drilling string 78. The drill bit 40 engages the formation 20 so as to directionally form the lateral borehole L adjacent the window W. In the exemplary operation of FIG. 5, the drill bit 40 is rotated by means of a downhole rotary motor 45.

After the lateral borehole L is formed, a liner (not shown) is run into the newly formed lateral wellbore L. The liner is hung from the parent wellbore casing 30, and then cemented in place.

In some lateral wellbore completions, a perforating gun is deployed in the parent wellbore 10 as well. In this respect, it is sometimes desirable to re-establish fluid communication within the parent wellbore with a producing zone at or below the depth of the whipstock 80. In such an instance, a perforating gun (not shown) is lowered into the liner for the lateral wellbore L. The perforating gun is lowered to the depth of the whipstock 80, and fired in the direction of the whipstock's deflection portion 170. This serves to create perforations through the perforation plate 110 and the liner of the lateral wellbore L (not shown). This, in turn, re-establishes fluid communication between the surface and the original producing formation of the parent wellbore.

Various explosive perforation devices are known, including but not limited to: a jet charge, linear jet charge, explosively formed penetrator, multiple explosively formed penetrator, or any combination thereof to preferably form a shaped charge. The presence of perforations in the perforation plate 110 allows valuable production fluids to migrate up the parent wellbore 10 from producing zones at or below the level of the whipstock 80. Production fluids flow through the anchor, the packer, the cavity in the whipstock body, and through the perforation plate. From there, fluids travel up the wellbore where they are captured at the surface.

It is understood that the creation of perforations through the perforation plate is typically done after the lateral borehole has been completed. Thus, charges must be of sufficient power to penetrate through the liner of the lateral borehole L, the surrounding column of cured cement (not shown) between the liner and the whipstock's perforation plate, and finally the perforation plate itself. In order to aid in the perforation of the whipstock's 80 perforation plate 110, it is desirable to have a perforation plate 110 on the whipstock 80 that is of a sufficiently thin or pliable metal to permit penetration by the perforating explosives. While such a composition aids in perforation of the whipstock 80, it also reduces the durability of the whipstock 80 during the milling operation. In this respect, the process of urging mill bits 60 downward against the perforation plate 110 of a whipstock 80 causes some inevitable sacrifice of the plate 110 of the whipstock 80 and, in some instances, removes all of the plate 110. This, in turn jeopardizes the ability of the whipstock 80 to deflect the mill bits, e.g., bits 200 and 250 against the casing 30. It also inhibits the whipstock's ability to withstand pressures within the wellbore 10. Still further, the uneven face surface of the perforation plate 110 resulting from sacrifice during the milling process reduces the effectiveness of the shaped charges.

Additionally, the prior art whipstock is difficult to manufacture. In this respect, the joining of the thin perforation plate and the outer body of the perforation whipstock is difficult to fabricate and can cause failures before the additional stress of the milling operation. This further jeopardizes the ability of the whipstock to withstand pressure within the wellbore, and increases the cost of manufacture.

While the pressure face is able to carry some pressure, because of the difficult manufacture process, the pressure retaining face is only able to carry a relatively low pressure, especially in larger sizes of whipstock assemblies. With the advances in other downhole tools, the requirements for this pressure retaining device to carry more pressure have exceeded its current capacity.

What is needed, then, is a whipstock arrangement that can be reliably manufactured and substantially prevents contact between the rotating mill bits, e.g., bits 200 and 250, and the perforation plate 110, while allowing for high pressure retaining capabilities.

SUMMARY OF THE INVENTION

The present invention provides a novel whipstock assembly for forming a window in a surrounding tubular, such as casing in a wellbore. The whipstock includes a deflection portion that has a perforation plate. The deflection portion is preferably a concave-shaped member, and is otherwise dimensioned to receive a milling bit during a window milling operation. Disposed along the perforation plate is a raised surface feature. In one arrangement, the raised surface feature defines a plurality of rails on which the milling bits ride during the milling operation. In one aspect, the rails define a plurality of substantially parallel rails equally spaced along the length of the concave-shaped member. In another aspect, the raised surface feature defines a raised elliptical edge formed along the whipstock body adjacent the concave-shaped member.

The raised surface feature is fabricated from a material that is capable of withstanding the stresses of a milling operation. The rails (or other raised surface) are also positioned in sufficient proximity to one another to substantially prevent the milling bits from frictionally engaging the perforating plate during the milling operation. At the same time, because the rails are not a continuous surface, they permit perforations to more uniformly penetrate the perforation plate of the whipstock. In this respect, the perforation plate surface is exposed between the rails and is fabricated from a softer material than is the raised surface. Alternatively, the rails define a thicker portion of material, meaning that the perforation plate is more readily penetrated by perforation shots between the rails.

The present invention also provides a novel method for manufacturing the whipstock. The method for construction employs "hollowing out" the back of the concave member and securing a cover over the cavity. In one arrangement, an arcuate perforation plate is welded inside the body of the whipstock, greatly increasing burst pressure capacity for the whipstock assembly. In another aspect, the whipstock is fabricated from two milled steel bars, welded together to form a front concave surface portion, and a back cover member, with a hollow cavity defined therebetween. In either arrangement, intermediate supports are placed between the face and back body members of the whipstock and within the hollow cavity, providing greater carrying capacity and a greater collapse pressure rating. Overall, these embodiments allow for a more reliable pressure vessel.

BRIEF DESCRIPTION OF THE DRAWINGS

So that the manner in which the above recited features of the present invention are attained and can be understood in detail, a more particular description of the invention, briefly summarized above, may be had by reference to the drawings that follow, i.e., FIGS. 6, 7A-C, 8, 9, 10A-G, 11, 12A-C, 13, 14, and 15. It is to be noted, however, that FIGS. 6, 7A-C, 8, 9, 10A-G, 11, 12A-C, 13, 14, and 15 illustrate only selected embodiments of this invention, and are not to be considered limiting of its scope.

FIG. 1 presents a cross-sectional view of a parent wellbore undergoing a sidetracking operation. Visible in this view are a packer, an anchor, and a whipstock being supported by the anchor. A working string is being run into the hole, with a starter mill attached.

FIG. 2 shows a cross-sectional view of a prior art perforation whipstock.

FIG. 7A presents a perspective view of the concave-shaped member; FIG. 7B shows the tubular body portion; and FIG. 7C shows the concave-shaped member and the tubular body portion having been joined together to form the whipstock.

DETAILED DESCRIPTION OF THE PREFERRED EMBODIMENT

Figure 6:
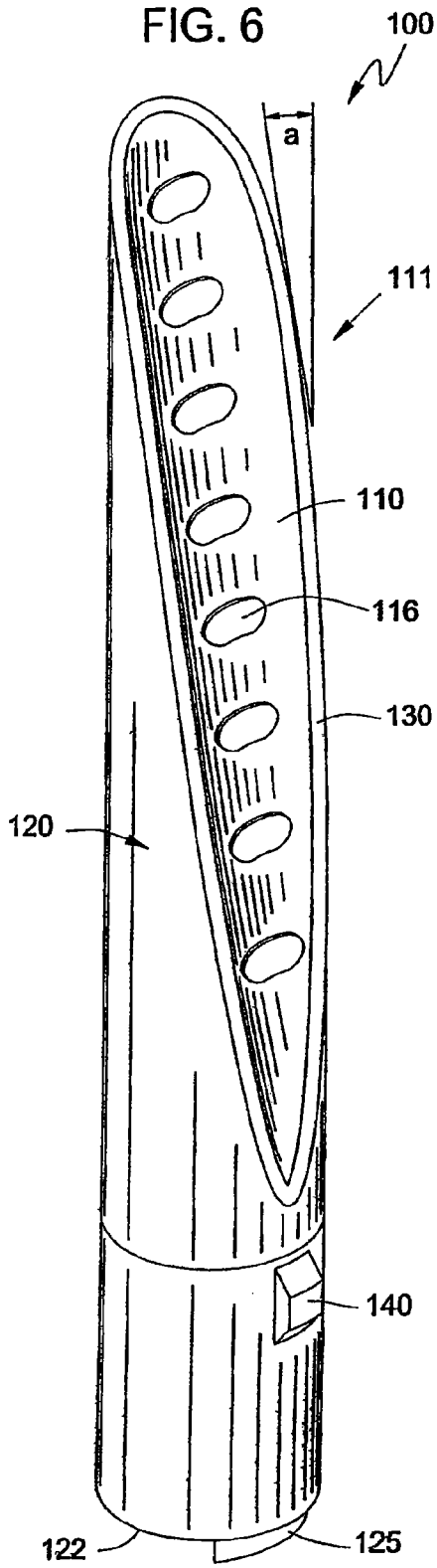
FIG. 6 presents a perspective view of a perforation whipstock, in one embodiment, of the present invention. In this arrangement, a raised ramp portion of the whipstock body is preserved along the concave-shaped member in order to provide a raised surface feature above the concave-shaped member.

FIG. 6 illustrates one embodiment of the whipstock assembly 100 of the present invention for milling a window W in a wellbore. The whipstock 100 has a top end and a bottom end 122. The bottom end 122 defines a base for the whipstock 100. The top end defines a concave-shaped member 111 and a back cover member 120. The back cover member 120 is an arcuate body. Together, the concave-shaped member 111 and the back cover member 120 form an outer metal shell and a generally hollow inner cavity therein.

The concave-shaped member 111 receives a milling bit (not shown) as the bit is urged downwardly into the wellbore during a milling operation. At the same time, the concave-shaped member 111 urges the milling bit outwardly against a surrounding tubular, e.g. casing (not shown) in order to form the window.

The inner cavity (not seen) within the whipstock 100 is in fluid communication with formation fluids below the hollow base 122. However, the concave-shaped member 111 and the back cover member 120 together form a pressure vessel preventing fluids from migrating further upward through the whipstock 100, at least until the concave-shaped member 111 is perforated. In this respect, the concave-shaped member 111 is capable of being penetrated by perforation shots, as will be more fully discussed below. Further, the concave-shaped member 111 includes a plate referred to as a perforation plate 110.

The whipstock 100 of FIG. 6 includes a novel raised surface feature 130. The raised surface feature 130 is designed to substantially prevent contact between a milling bit and the perforation plate 110 during the window forming operation. In the arrangement of FIG. 6, the raised surface feature 130 defines a ramp portion preserved in the back cover member 120 along the concave member 111. In this manner, an elliptical lip is formed around the concave member 111 to protect the plate 110 during milling. The raised surface feature is non-continuous, meaning that at least portions of the surface area of the perforation place is exposed to perforation shots.

Figure 14:
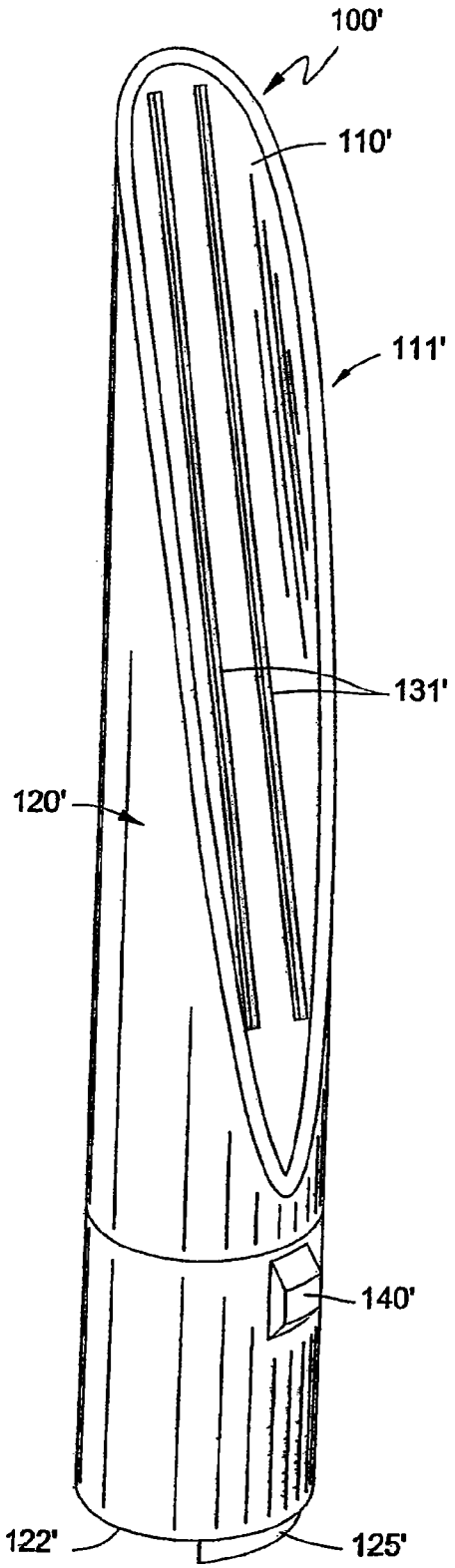
FIG. 14 provides a perspective view of a whipstock assembly of the present invention, in yet an additional alternate embodiment. A milling bit support geometry is provided along the perforation plate of the whipstock. The milling bit support geometry in this arrangement defines at least two elongated and substantially parallel rails.
Figure 15:
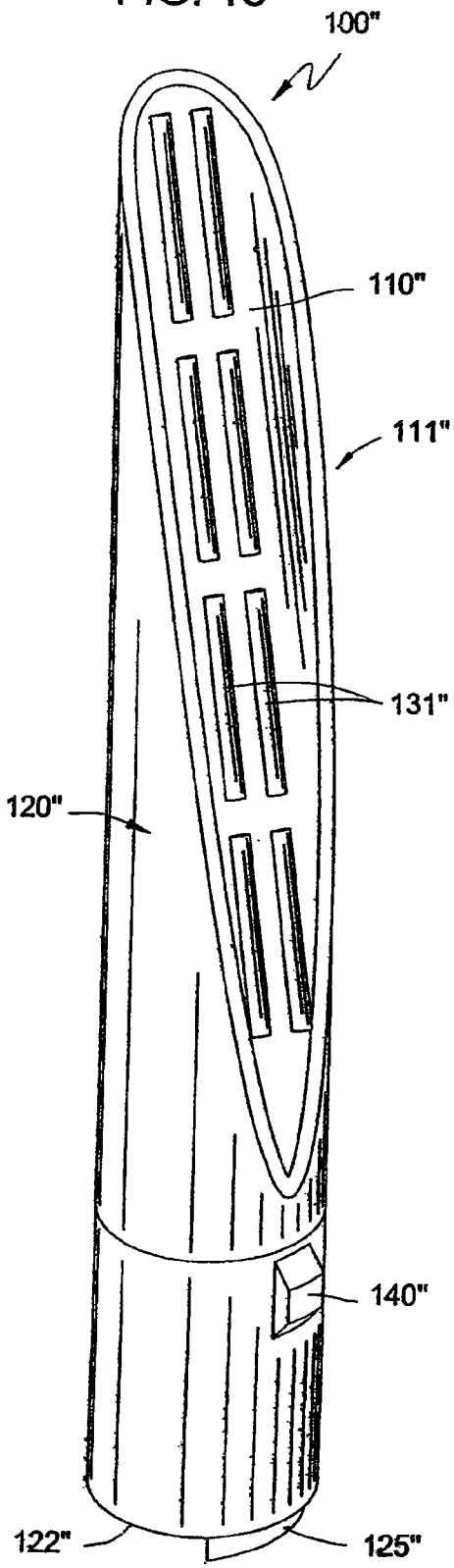
FIG. 15 depicts a perspective view of a whipstock assembly, having an alternate design for the milling bit support geometry. Here, the geometry defines a series of substantially parallel rails having oval cross-sectional areas.

The raised surface feature 130 may take any form. For example, the raised surface feature may define a plurality of rails on which the mill rides during a milling operation. Additional exemplary embodiments are illustrated in FIGS. 13-15.

Figure 13:
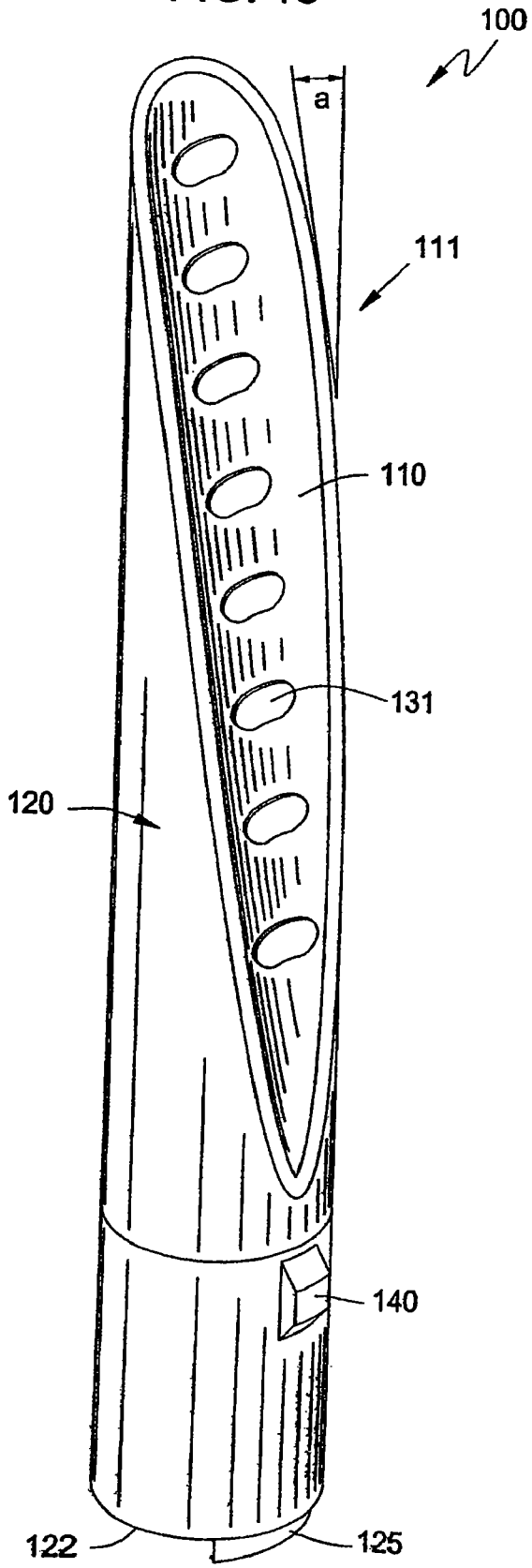
FIG. 13 presents a perspective view of a perforation whipstock, in an alternative embodiment. The whipstock again employs the novel raised surface feature of the present invention. In this arrangement, the raised surface feature comprises a plurality of linearly disposed raised geometries.

FIG. 13 presents a perspective view of a perforation whipstock 100, having an alternative raised surface feature arrangement. In this arrangement, the raised surface feature comprises a plurality of linearly disposed raised geometries 131. More specifically, a plurality of rails 131 is attached to the outer surface of the concave member 111. Again, the rails are non-continuous. The rails 131 are preferably equally-spaced-apart substantially along the length of the concave member 111. The rails 131 are preferably oriented normal to the longitudinal axis of the concave member 111. However, it is understood that the rails 131 may be in other configurations, such as longer raised surface members oriented in the direction of the longitudinal axis of the concave member 111, as will be described more fully below.

Figure 3:
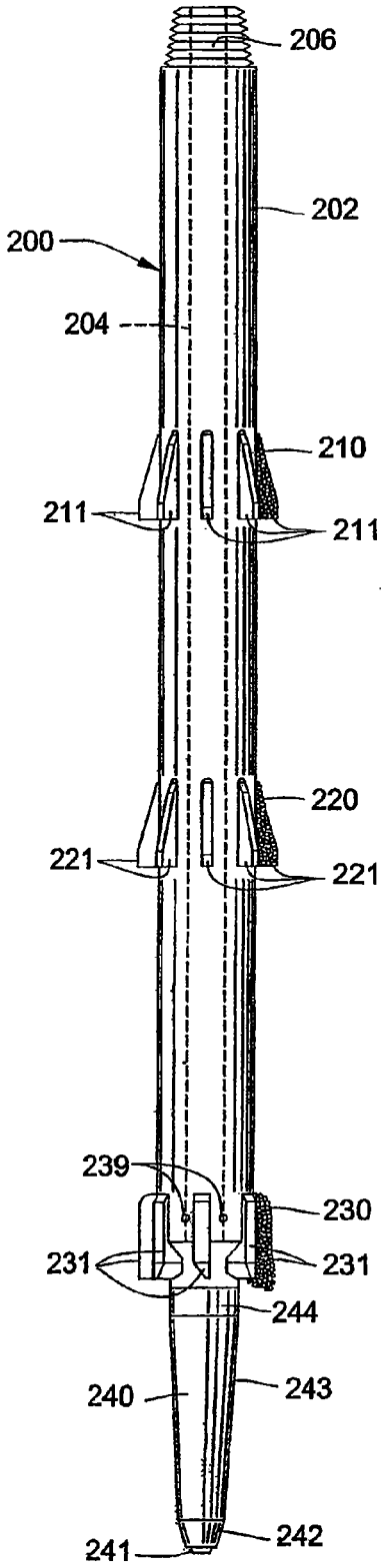
FIG. 3 provides a side view of an exemplary starter mill as might be used in a sidetracking operation. The starter mill includes a lower nose portion that is releasably connected to a sacrificial pilot lug (not shown).
Figure 4:
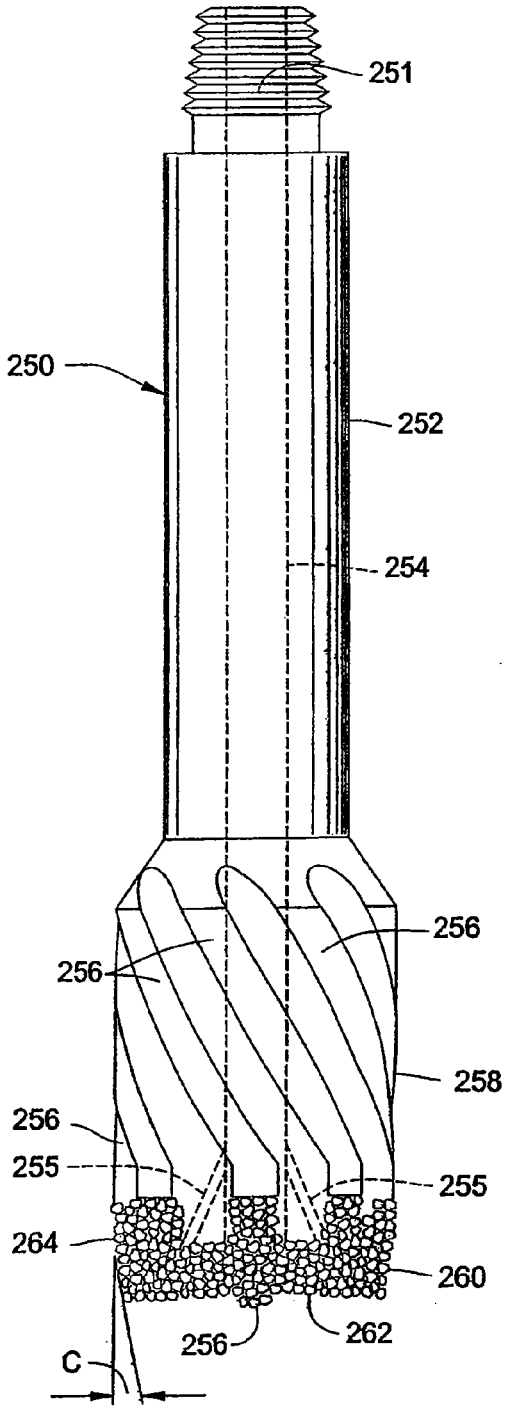
FIG. 4 shows a side view of an exemplary window mill as might be used in a milling operation.
Figure 5:
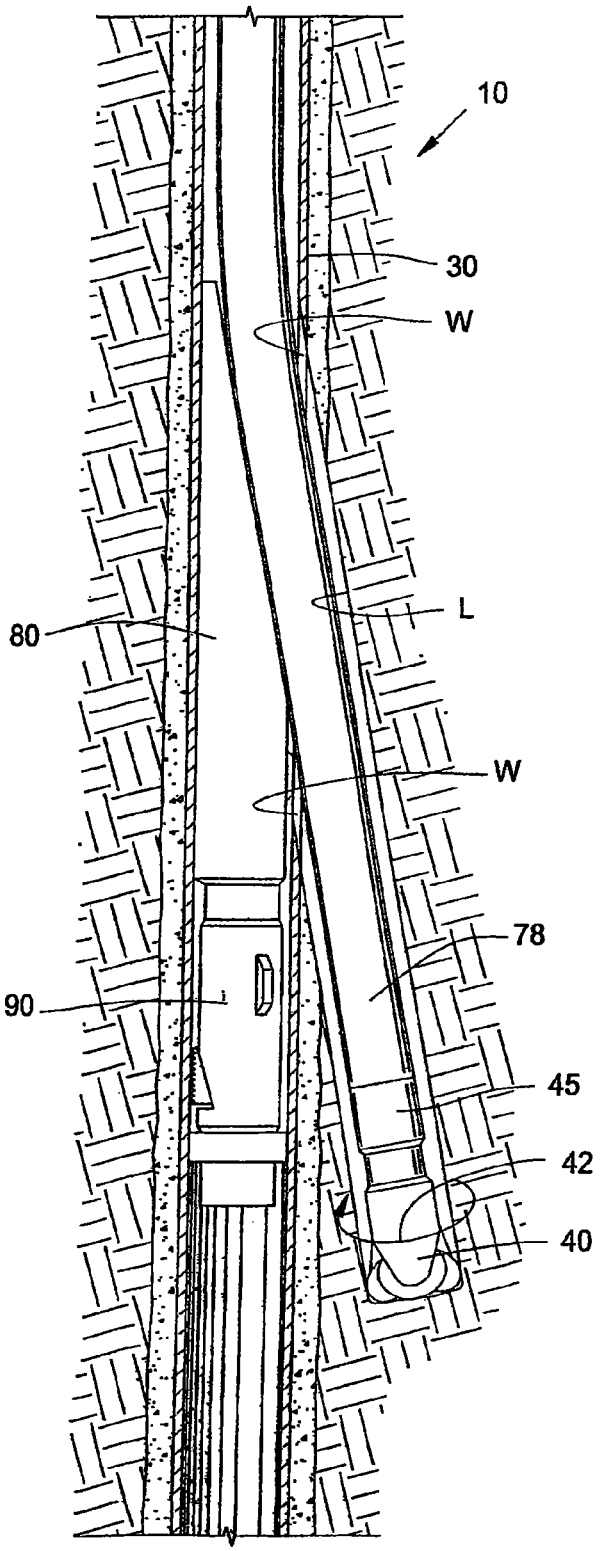
FIG. 5 is a cross-sectional view of the parent wellbore of FIG. 1. In this view, a window has been formed in the casing, and a lateral wellbore is being drilled into the formation. A liner string is shown along the whipstock, extending into the lateral wellbore as part of the lateral completion.

The rails 131 may be fabricated from the same material as the plate 110, e.g., metal. Because the rails 131 are thicker, deterioration of the plate 110 by the milling bits, e.g., bit 250 of FIG. 4, is restrained. However, it is preferred that the rails 131 be fabricated from a material that is hardened. In this respect, the rails 131 will resist deterioration by the milling bits. At the same time, the perforation plate 110 will be fabricated from a material that is softer than the rails 131, and more readily penetrated by perforating shots.

As noted, the rails 131 are spaced apart in order to provide numerous gaps through which perforation shots may directly penetrate the perforation plate 110. At the same time, the rails 131 are in sufficient proximity to one another to substantially prevent the milling bits from frictionally engaging the perforation plate 110 during the milling operation.

FIGS. 14 and 15 present alternate geometrical arrangements for a raised surface feature. In FIG. 14, a pair of elongated rectangular (or other polygonal) rails 131' is provided on the plate 110'. In FIG. 15, a series of substantially parallel rails 131" having oval cross-sectional areas is provided. Thus, it can be seen that the present invention is not limited to the geometrical array of the milling bit support geometry.

The raised surface feature, e.g., ramp 130 or rails 131, 131', 131", provide a milling bit support geometry for withstanding the stresses of a milling operation, and for substantially preventing the mill from frictionally engaging the perforating plate 110 during a milling operation. This, in turn, prevents substantial degradation of the plate 110 during the window milling operation. Yet, because the ramp 130 or rails 131, 131', 131", are not a continuous surface, they more readily permit perforations to uniformly penetrate the perforation plate 110 of the whipstock 100.

As can be seen from FIGS. 6, 13, 14 and 15, the concave-shaped member 111 extends from the top end of the whipstock 100 downward. A gentle angle, e.g., 3 to 5 degrees, is typically provided to permit angular deviation of the working string during milling. In the case of a perforation whipstock 100, the concave member 111 includes a plate referred to as a "perforation plate" 110. In the past, perforation plates have been placed on top of a ramp surface formed along the back cover member of the whipstock, and simply welded on. Intermediate structural support members (not shown) were placed behind the perforation plate to provide greater collapse pressure capacity for the whipstock. However, this arrangement left a structural weakness in the whipstock that greatly limited burst pressure capacity. Thus, the whipstock assembly 100 of FIG. 6 also provides an improved design having greater burst pressure capacity.

Figure 7A:
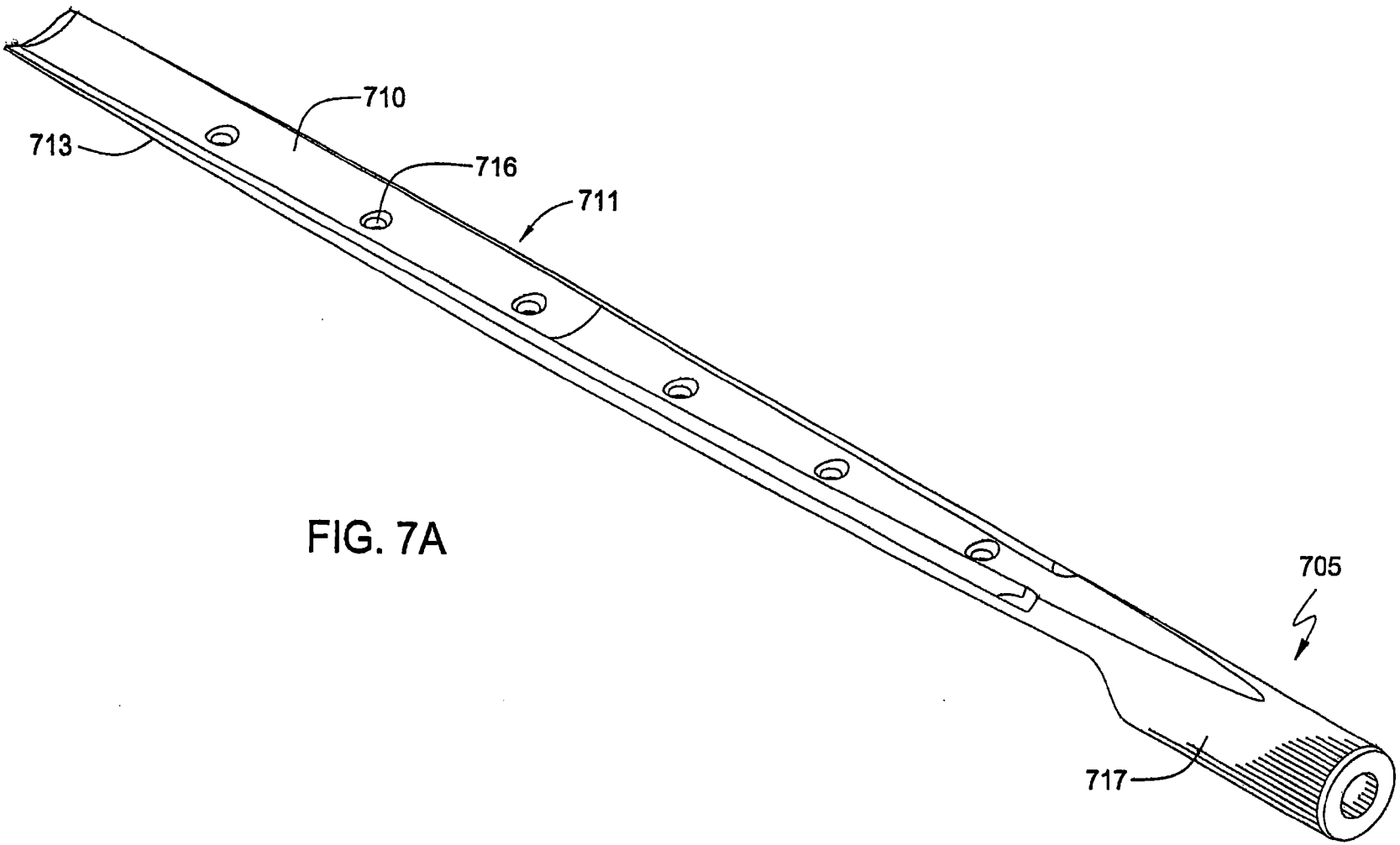
FIGS. 7A-C present perspective views of the perforation whipstock of FIG. 6 according to one method of manufacture.
Figure 7B:
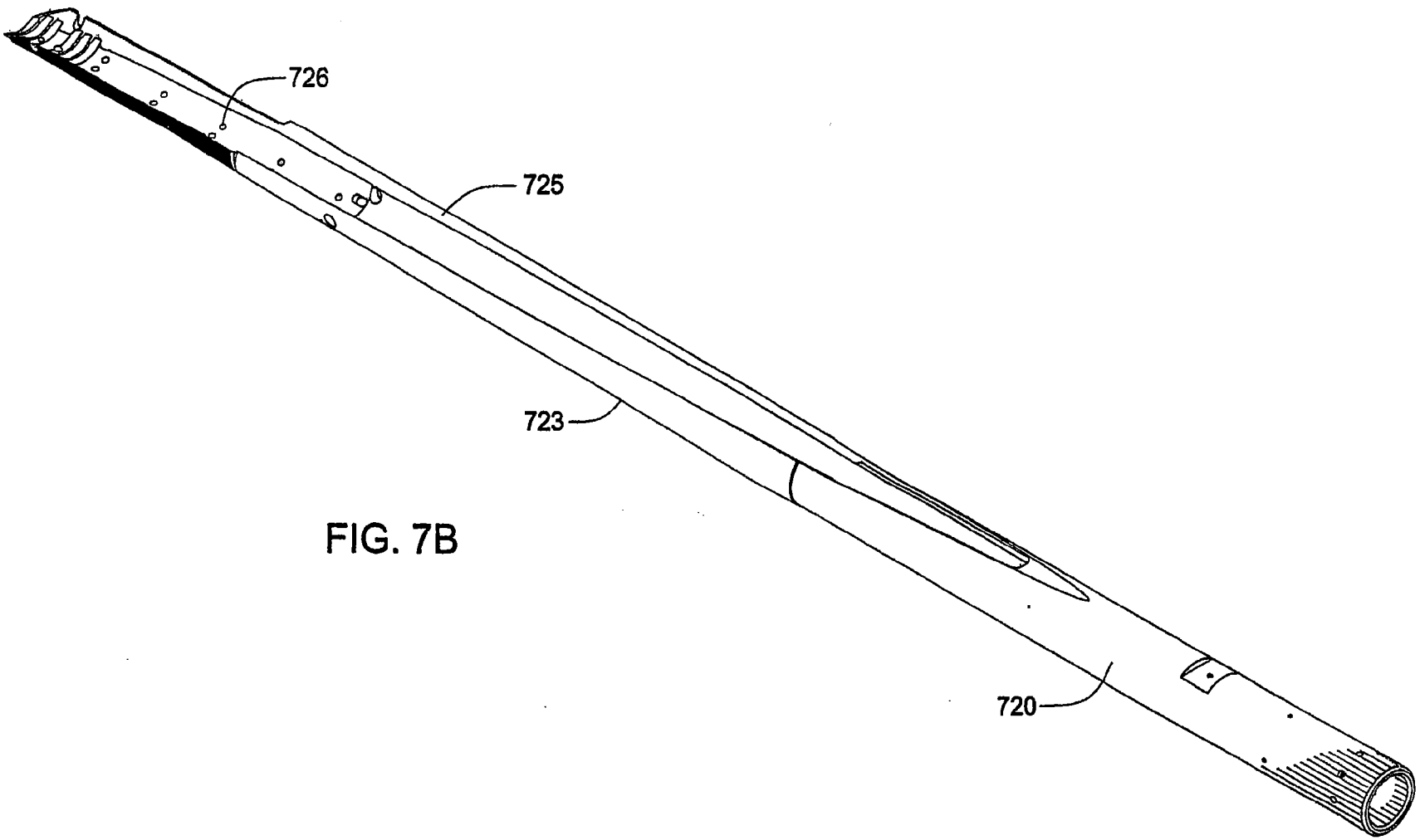
Figure 7C:
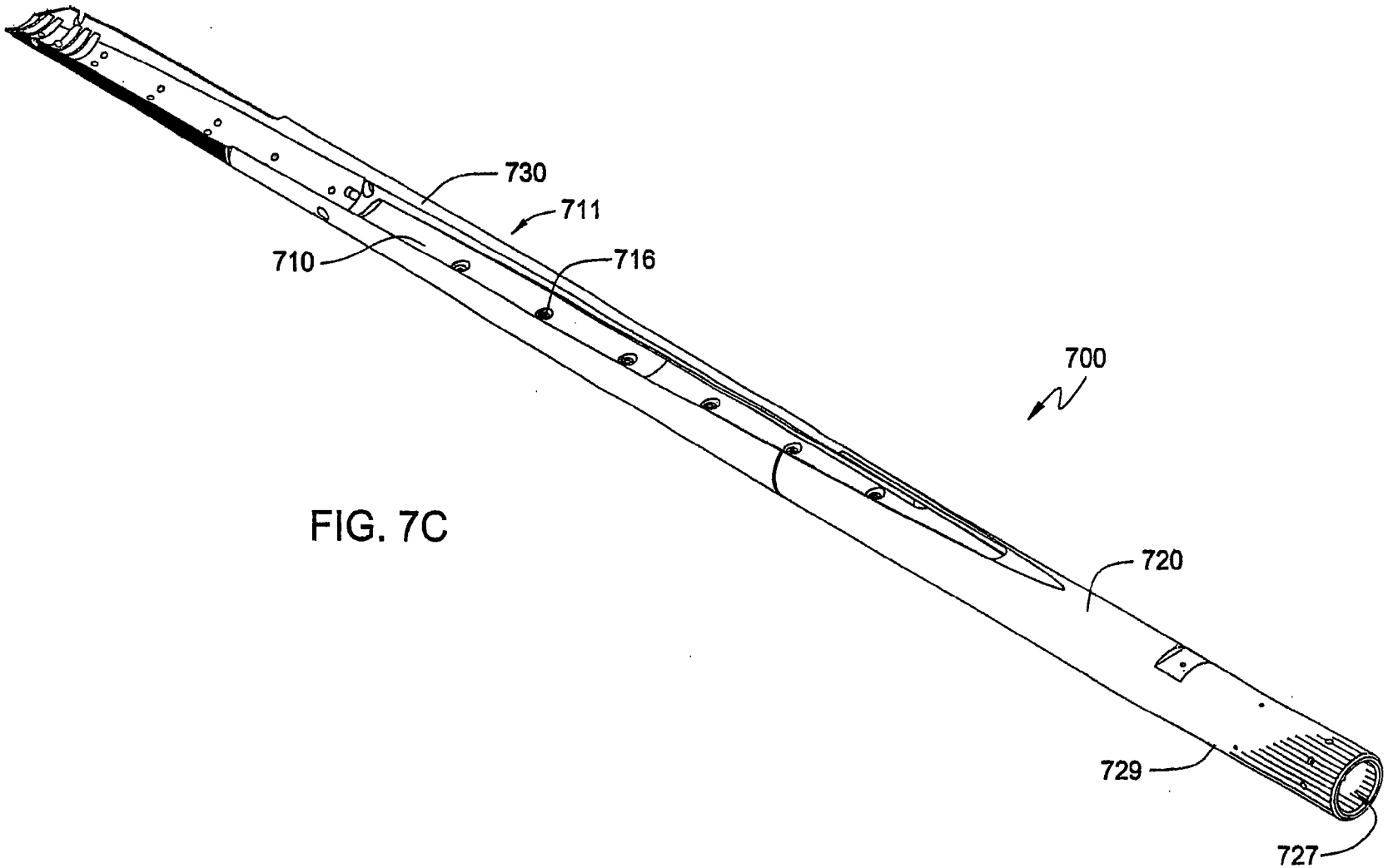

FIGS. 7A-C present perspective views of the perforation whipstock 100 of FIG. 6 according to one method of manufacture. FIG. 7A presents a perspective view of a concave-shaped member 710; FIG. 7B shows a tubular back body member 720; and FIG. 7C shows the concave-shaped member 711 and the tubular back body member 720 having been joined together to form a whipstock 700.

In the whipstock assembly 700 of FIG. 7C, the concave-shaped member 711 and the tubular back body member 720 are each manufactured by milling elongated bodies. As seen in FIG. 7A, the concave-shaped member 711 has a plurality of welding openings 716 manufactured along its length. A lower tubular portion 705 of the concave-shaped member 711 is retained. The concave-shaped member 711 is then inserted into the tubular back body member 720.

FIG. 7B shows the back body member 720 also having a lower tubular section retained. The back body member 720 includes an elliptical cutout section 725. The elliptical cutout section 725 allows the first milled tubular 705, whose outside diameter is slightly smaller than the inside diameter of the second milled tubular 720, to be inserted within the second tubular 720. The second tubular 720 also contains a plurality of support holes 726. Once the first tubular 705 is inserted into the desired position within the second tubular 720, intermediate support rods (shown at 706 in FIG. 8) are inserted through the plurality of support holes 726 in the second tubular 720. The support rods are then secured (such as by welding) to the back body member 720 at the point of the holes 726. Similarly, the support rods are welded to the concave-shaped member 711 through welding openings 716. The intermediate support rods significantly enhance the strength and pressure retaining capability of the perforation plate section 710.

The concave-shaped member 711 and the back body member 720 are adjoined by welding the intermediate support rods to both portions 711 and 720. In addition, the concave-shaped member 711 and the tubular back body member 720 may be adjoined by welding the edge of the concave-shaped member 711 to the inner cavity of the back body member 720, as will be shown in further detail in FIGS. 10A-G.

FIG. 7C shows the completed whipstock assembly 700 having the concave-shaped member 711 inserted within the tubular back body member 720. As shown in FIG. 6 and FIG. 7C, the raised edge 130, 730 resulting from the elliptical cutout 725 on the back body member 720 protrudes radially from the concave-shaped member 711. The raised elliptical edge 730 functions as rails which contact and consequently divert the mill or running tool (not shown) outward in the desired lateral direction while preventing the mill or running tool from contacting the surface of the plate 710.

Figure 8:
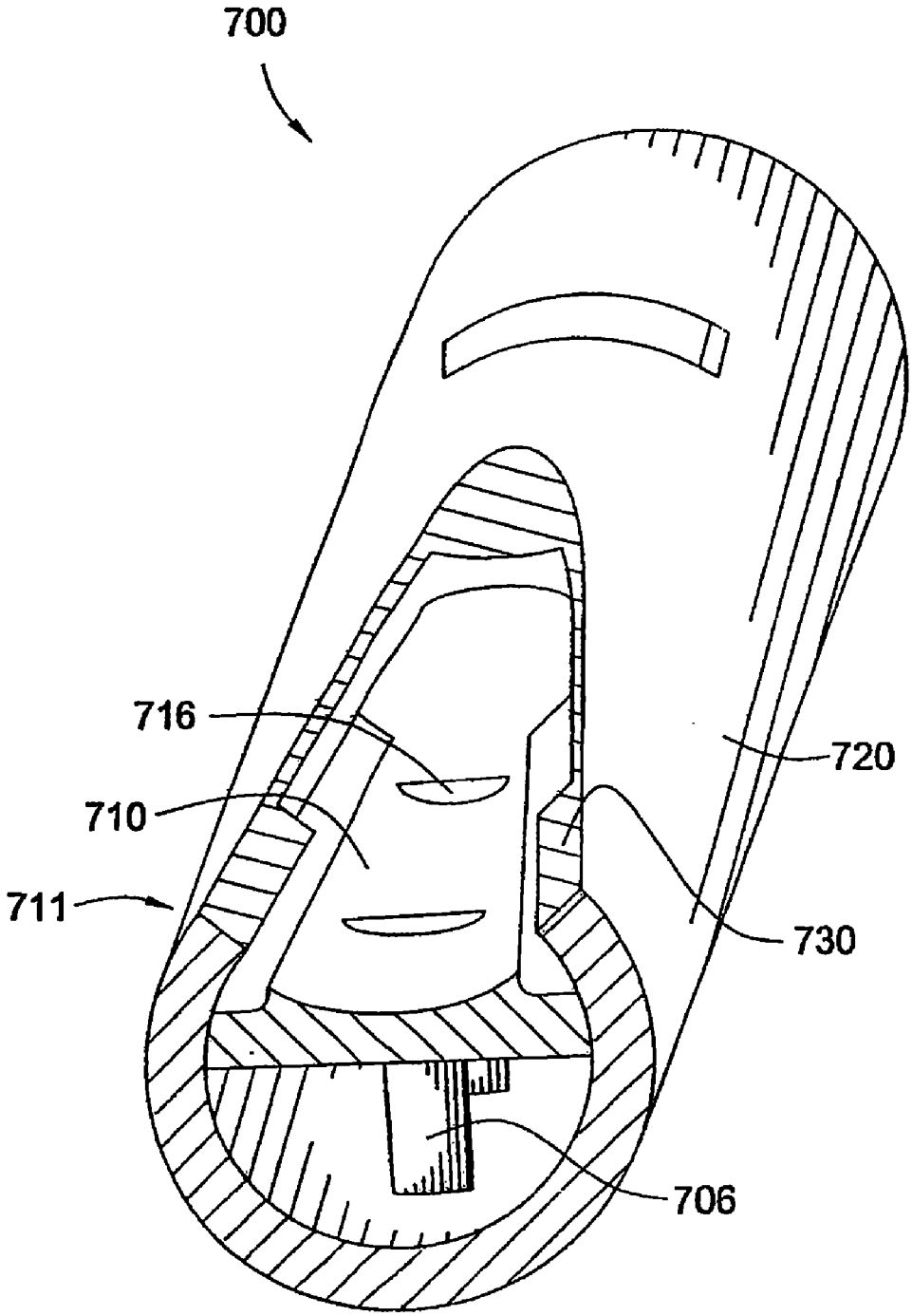
FIG. 8, presents a cross-sectional perspective view of the whipstock assembly of FIG. 7C.

FIG. 8 shows a cross-sectional perspective view of the whipstock assembly 700 of FIG. 7C. As shown in FIG. 8, the intermediate support rods 706 serve to adjoin the two milled tubulars, i.e., the concave-shaped member 711 and the tubular back body member 720.

Figure 9:
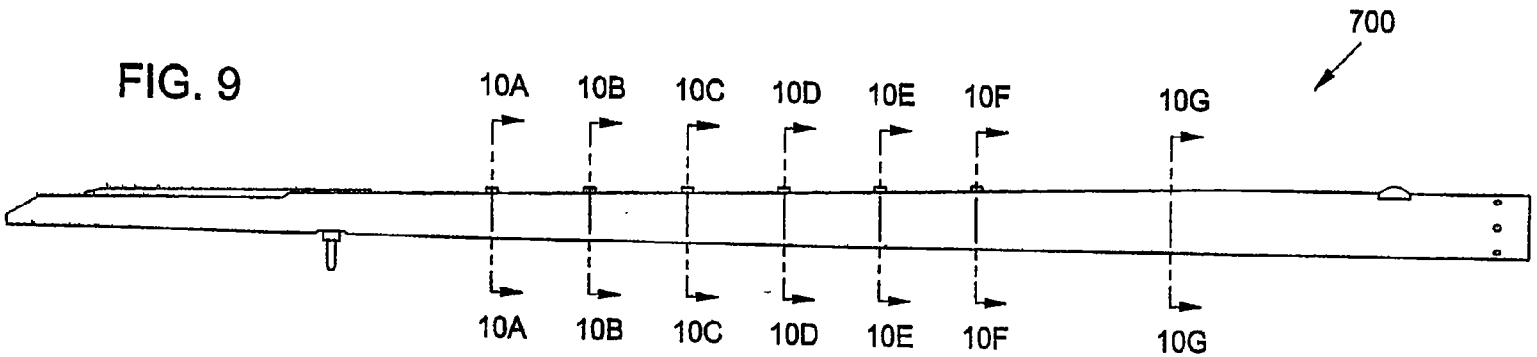
FIG. 9 is a schematic side view of the perforation whipstock of FIG. 7C.
Figure 10A:
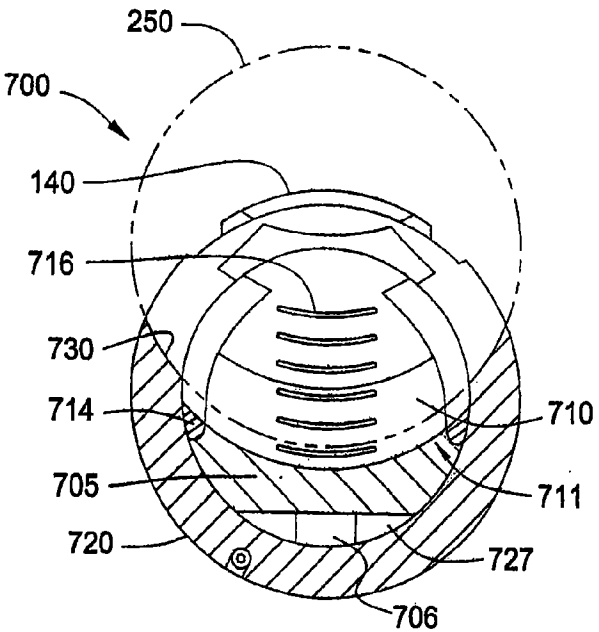
FIGS. 10A-10G present top, cross-sectional views of the whipstock of FIG. 9, taken across progressively lower cuts in the whipstock.
Figure 10D:
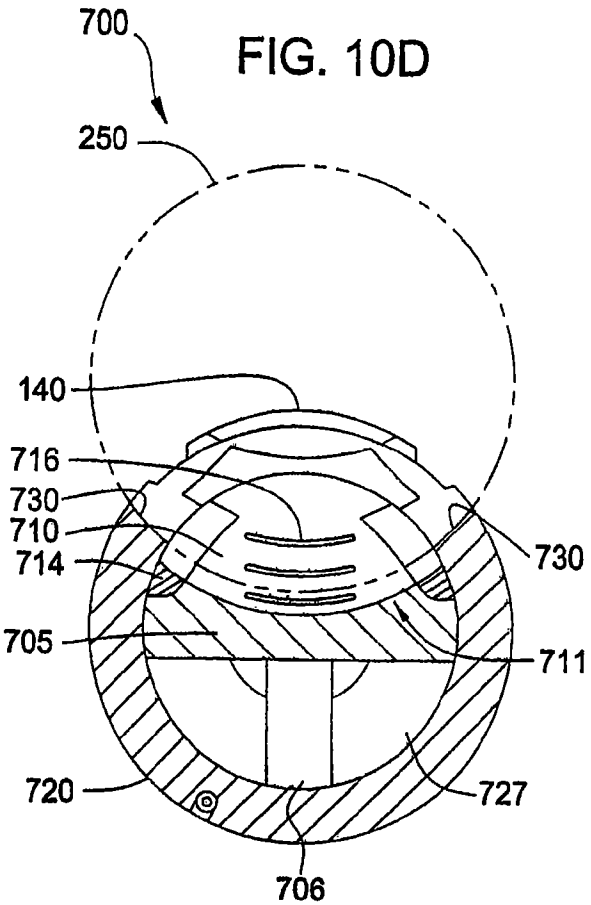
Figure 10C:
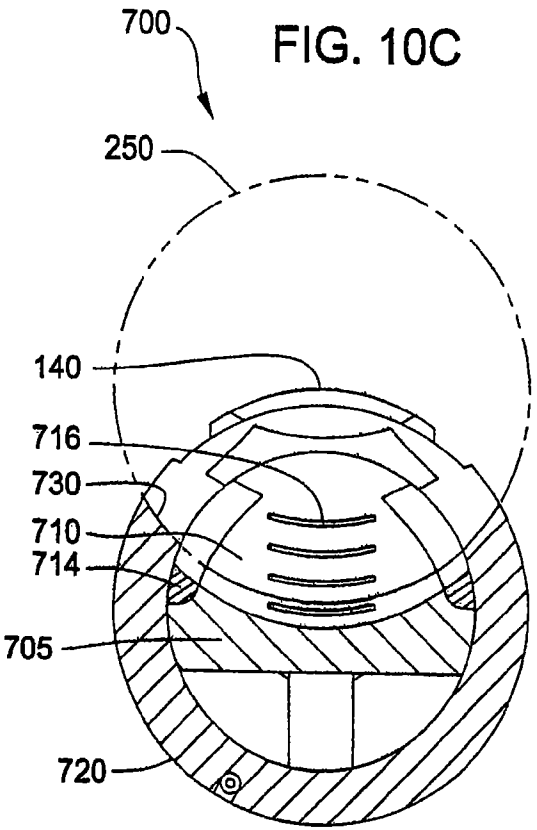
Figure 10B:
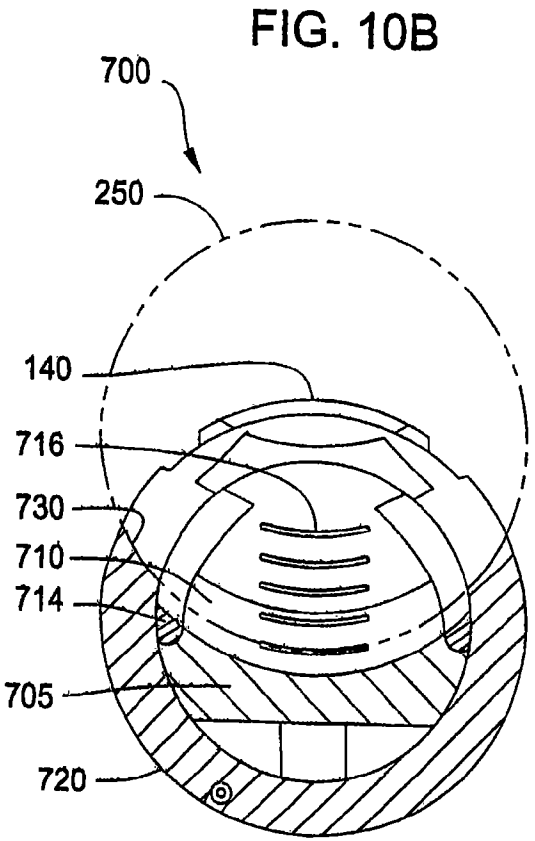
Figure 10G:
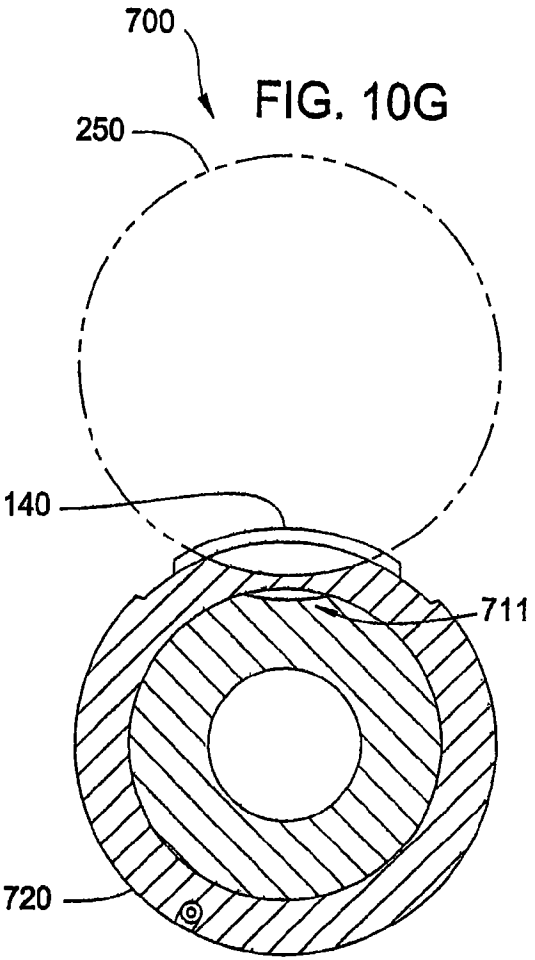
Figure 10F:
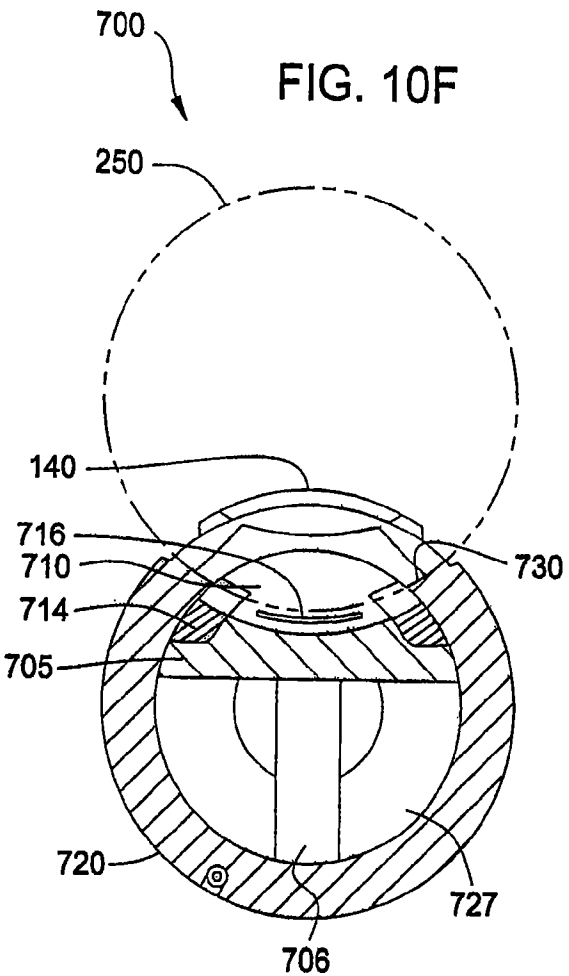
Figure 10E:
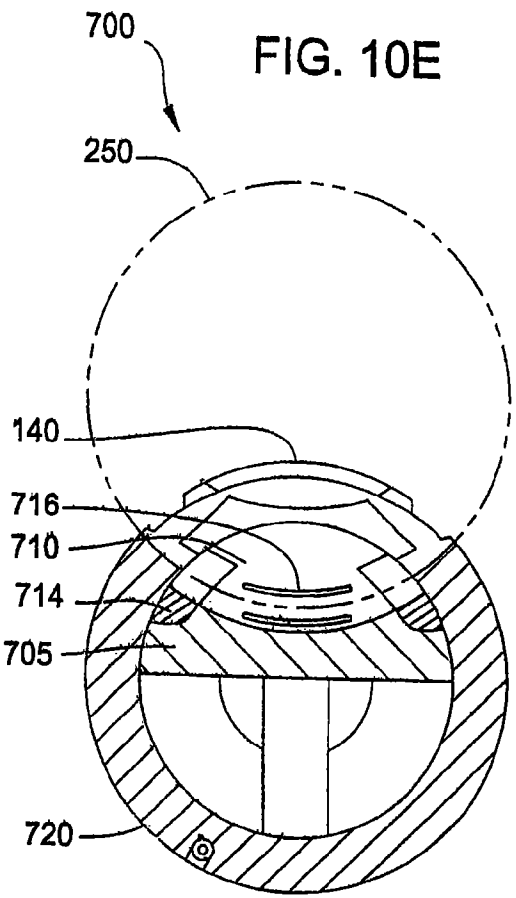

FIG. 9 presents a schematic view of the whipstock 700 of FIG. 7C, in side view. Various lines are superimposed upon the drawing for cross-sectional reference. FIGS. 10A-10E present top, cross-sectional views of the whipstock of FIG. 9, taken across progressively lower lines in the whipstock 700. The views are as follows:

FIG. 10A provides a cross-sectional view of the whipstock 700 taken across line A-A;

FIG. 10B is a cross-sectional view of the whipstock 700 taken across line B-B;

FIG. 10C shows a cross-sectional view of the whipstock 700 taken across line C-C;

FIG. 10D depicts a cross-sectional view of the whipstock 700 taken across line D-D;

FIG. 10E presents a cross-sectional view of the whipstock 700 taken across line E-E;

FIG. 10F is a cross-sectional view of the whipstock 700 taken across line F-F; and FIG. 10G provides a cross-sectional view of the whipstock 700 taken across line G-G.

Visible in the views of FIG. 10A through FIG. 10F is the back cover member 720 of the whipstock 700. Also visible in each of these views is the concave-shaped member 711. A welding material 714 connects the concave-shaped member 711 to the back body 720. A stationary pad 140 can also be seen. The stationary pad 140 mounts on the lower portion 122 of the body, as shown in FIG. 6. In addition, the plurality of weldment holes 716 is presented on the plate 710. A cavity 727 is formed between the concave-shaped member 711 and the back body 720. An intermediate support member 706 is also visible.

FIGS. 10A through 10F also present, in phantom, the window mill 250. In each view, the window mill 250 is riding upon the rails 730 above the perforation plate 710. However, in FIG. 10G, the window mill 250 is positioned at the lowest section of the raised elliptical edge or rail 730, as the milling bit 250 has advanced passed the concave-shaped member 711 of the whipstock 700.

In one arrangement, the method for creating a whipstock assembly of the present invention comprises a first step of milling a first elongated body 720 in order to form at least one convex (back) surface 723, and an opposite ramp surface 725. Second is the step of milling a second elongated body 705 in order to form at least one ramped concave member 711, and an opposite cavity surface 713. Next, the first elongated body 720 is placed adjacent to the second elongated body 705 so as to form an elongated cavity 727 defined by the ramp surface 725 of the first body 720 and the cavity surface 713 of the second body 705. The first body 720 and the second body 705 are welded together. In this manner, a pressure vessel is formed.

In one arrangement, and as mentioned above, a tubular portion is provided at a lower end of both the first 720 and second 705 elongated bodies. The tubular portion 717 in the second body 705 is configured to be received within the tubular portion 729 in the first body 720. Optionally, at least two openings 726 are provided along the length of the first elongated body 720. Thereafter, an intermediate support member (not shown) is placed through each of the at least two openings 726 along the length of the first body 720. The intermediate support members are welded in place at each of the at least two openings 726 along the length of the first body 720.

Optionally, at least two openings 716 are also milled along the length of the second elongated body 705 on the plate 710. The intermediate support members (not shown) may then also be welded in place at each of the openings 716.

Still further, the method may include the step of providing a raised surface feature outwardly from the plate 710 of the second elongated body 705 such that the raised surface feature substantially prevents contact between a milling bit and a length of the plate 710 of the second body 705 during a window milling operation. In one aspect, the step of providing a raised surface feature is performed by milling a ramp 730 along an edge of the convex surface of the first elongated body 720.

Figure 11:
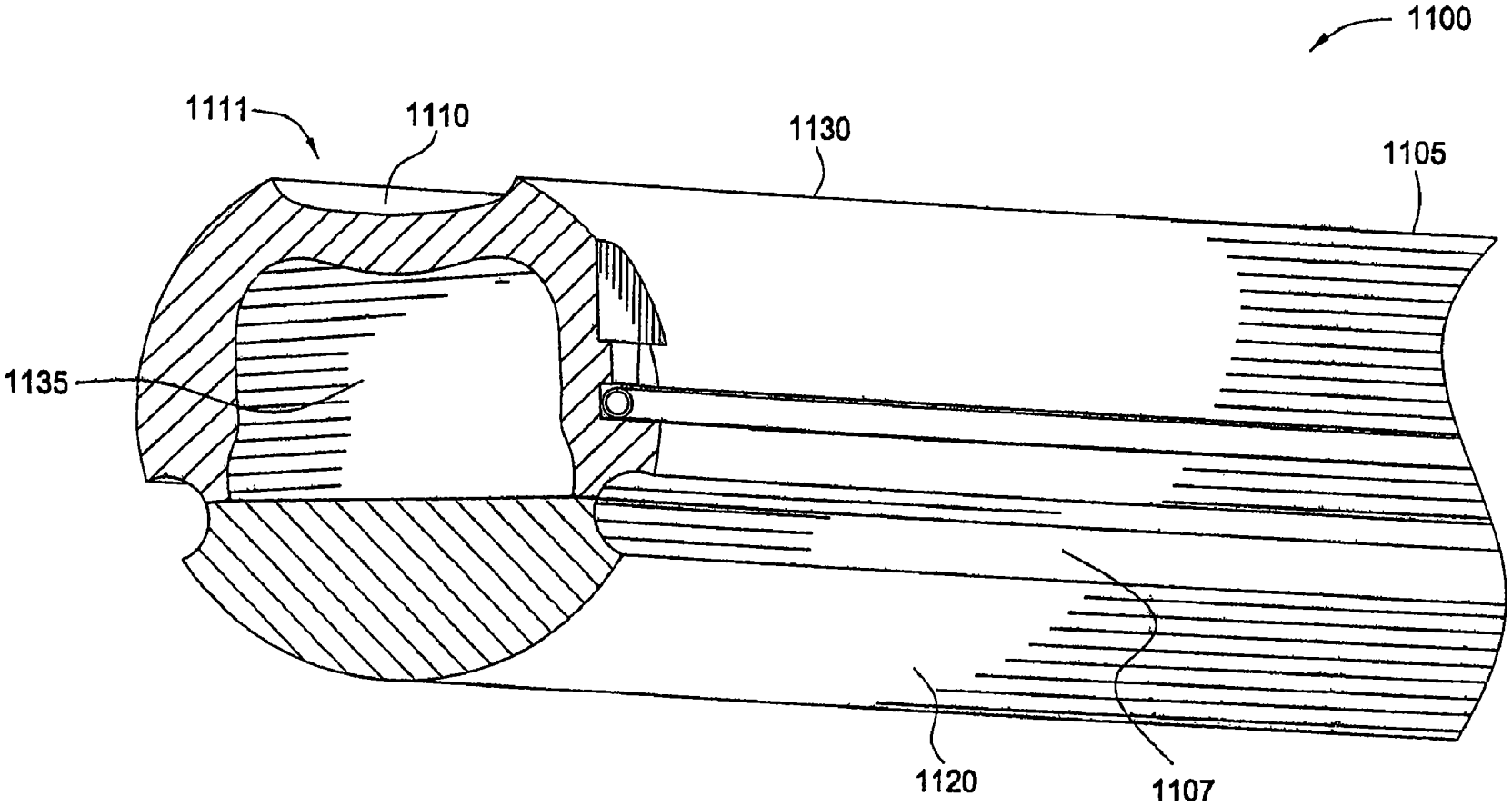
FIG. 11 presents a cross-sectional perspective view of the perforation whipstock of FIG. 6, according to a second method of manufacture. Separate concave-shaped member and back body portions are seen. The cut is seen at a lower end of the concave-shaped member.

FIG. 11 illustrates yet another method of manufacturing the whipstock assembly 100 of FIG. 6. In this figure, the whipstock assembly is referenced as 1100. FIG. 11 provides a small portion of the whipstock assembly 1100, with a cross-section shown in perspective near the top of the whipstock 1100.

A concave-shaped member 1111 (or deflecting member 1105) and a separate back cover member 1120 are again provided. Each of these members 1111, 1120 defines an elongated body that is fabricated by milling a solid bar, either circular or other profile, to reach the profiles shown in FIG. 11. The first member 1105 is milled to form at least one ramped concave surface 1111 and an opposite cavity surface. The second member 1120 is milled to form at least one convex surface and an opposite cavity surface. The two members 1105, 1120 are then welded together to form a hollow cavity there between 1135. Arcuate recesses 1107 are formed in each member 1105, 1120 for receiving weldment material. The two members 1105, 1120 are connected so that the recesses 1107 are aligned. Intermediate supports (not shown) may again be placed within the hollow cavity 1135 in order to provide greater pressure carrying capacity for the whipstock 1100. In this manner, a pressure vessel is formed.

A raised edge 1130 resulting from milling of an elliptical surface on the convex surface of the second back cover member 1120 protrudes radially above the perforation plate 1110. The raised elliptical edges 1130 function as rails which contact and consequently divert the mill or running tool (not shown) outward in the desired lateral direction while preventing the mill (or running tool) from contacting the surface of the plate 1110.

Figure 12C:
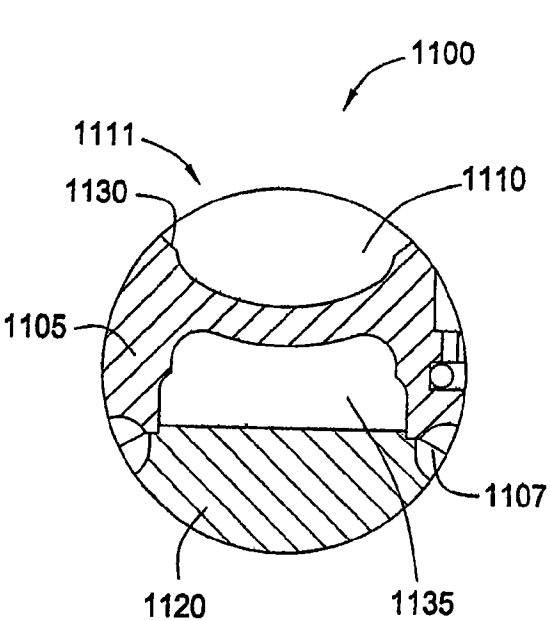
FIGS. 12A-C, present top, cross-sectional views of the whipstock assembly of FIG. 11.
Figure 12B:
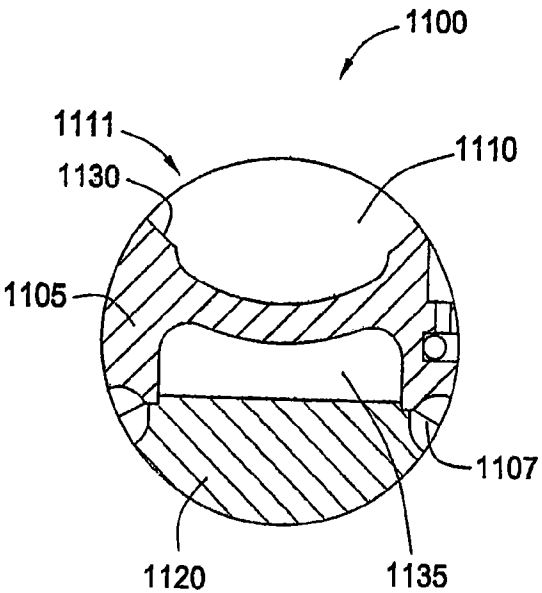
Figure 12A:
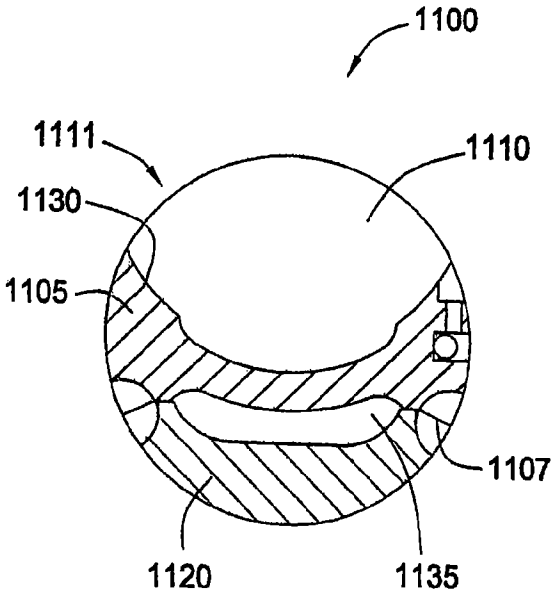

FIGS. 12A-C present top, cross-sectional views of the whipstock assembly 1100 of FIG. 11. FIG. 12A shows a cross-sectional view taken near the upper end of the whipstock 1100; FIG. 12C provides a cross-sectional view taken near the lower end of the whipstock 1100; FIG. 12B shows a cross-sectional view taken between the upper and lower ends of the whipstock 1100.

Two beneficial features of the whipstock assembly 1100 can be immediately discerned from the cross-sectional figures—FIGS. 12A-C. First, it can be seen that the thickness of the perforation plate portion 1110 through the respective cuts is uniform. In this respect, the perforation plate portion 1110 has a substantially uniform cross-sectional wall thickness along a portion of its width. Preferably, the perforation plate portion 1110 also has a substantially uniform cross-sectional wall thickness along a substantial portion of its length. This provides for more consistent charge penetration during perforation. It also assists the operator in designing the appropriate charge. Those of skill in the art will understand that it is desirable to penetrate the perforation plate 1110 with perforation shots, but not the back cover member 1120. Second, because the whipstock's hollow cavity 1135 is specially milled from the backside of the whipstock 1100, a thicker back cover cross section may be fabricated into the whipstock 1100, thereby allowing for larger perforation charges to be safely used in creation of the perforations, while preventing penetration through the back cover member 1120 and the parent casing. Those skilled in the art will appreciate that inadvertent perforation through the back 1120 of the whipstock 1100 and through the casing 30 can result in the production of unwanted materials.

Referring back now to FIG. 6, in order to maximize the effectiveness of the raised surface feature 130, it is preferable to employ a mill having elongated blades, such as blades 256 shown in FIG. 4. In addition, it is preferable that the lower ends of the blades 256 of the window mill body 252 taper inwardly from the outer surface toward the body center at an angle "d". This taper feature tends to pull the body 252 outwardly in a direction away from the whipstock's concave-shaped member 111 and into the casing 30, acting like a mill-directing wedge ring. Also, this presents a ramp to the casing 30 which is so inclined that the mill end tends to move down and radially outward rather than toward the whipstock 100.

While the foregoing is directed to embodiments of the present invention, other and further embodiments of the invention may be devised without departing from the basic scope thereof, and the scope thereof is determined by the claims that follow.

The invention claimed is:

1. A whipstock assembly, comprising:

a first elongated body having an outer surface and a first interior cavity surface;

a second elongated body having a ramped concave surface, a second interior cavity surface, and an interior sidewall surface extending from each side of the second interior cavity surface, wherein the ramped concave surface is adapted to guide a milling tool, wherein the first and second bodies are elongated along an axial length of the whipstock assembly; and a connection edge disposed along a longitudinal length of each body to couple the bodies together such that the first and second interior cavity surfaces and the interior sidewall surfaces form a pressure holding cavity, wherein a length of the first elongated body extends from an upper longitudinal end to a lower longitudinal end of the second elongated body when coupled together.

2. The whipstock assembly of claim 1, wherein the ramped concave surface includes a guide rail adapted to direct a milling bit of the milling tool along the ramped concave surface.

3. The whipstock assembly of claim 1, wherein the ramped concave surface includes a raised surface feature adapted to direct a milling bit of the milling tool along the ramped concave surface.

4. The whipstock assembly of claim 1, wherein the ramped concave surface includes a perforation plate adapted to be perforated by a perforating gun.

5. The whipstock assembly of claim 4, wherein the ramped concave surface is adapted to deflect a milling bit of the milling tool from contacting the perforation plate.

6. The whipstock assembly of claim 5, further comprising a raised surface feature above the perforation plate for deflecting the bit as it travels downward along the ramped concave surface, wherein the raised surface feature is a plurality of longitudinally disposed deflectors spanning substantially a length of the perforation plate.

7. The whipstock assembly of claim 1, wherein the second interior cavity surface is opposite the ramped concave surface and includes a convex surface disposed between the interior sidewall surfaces.

8. The whipstock assembly of claim 1, wherein the connection edge forms an arcuate recess disposed between the first elongated body and the second elongated body for receiving a weldment material.

9. The whipstock assembly of claim 1, further comprising an intermediate support disposed in the cavity and coupled to the first elongated body and the second elongated body, and operable to increase pressure capacity of the cavity.

10. The whipstock assembly of claim 1, wherein the ramped concave surface has a substantially uniform cross-sectional wall thickness along a substantial portion of its longitudinal length.

11. The whipstock assembly of claim 1, wherein the first elongated body has a cross-sectional wall thickness greater than the ramped concave surface of the second elongated body.

12. The whipstock assembly of claim 1, wherein the connection edges align to form a recess configured to couple the bodies together to form the pressure holding cavity.

13. The whipstock assembly of claim 1, wherein the first interior cavity surface of the first elongated body has a substantially flat profile at a first end of the first elongated body.

14. The whipstock assembly of claim 13, wherein the first interior cavity surface of the first elongated body has a substantially flat profile with curved edges at a second end of the first elongated body.

15. The whipstock assembly of claim 1, wherein the pressure holding cavity is configured to contain wellbore pressure from below the whipstock assembly and prevent migration of wellbore fluids upward through the whipstock assembly.

16. A method for creating a whipstock assembly, comprising:

providing a first elongated body with a back surface and a first inner surface;

providing a second elongated body with a ramped concave surface, a second inner surface, and two inner sidewall surfaces, wherein the first and second bodies are elongated along an axial length of the whipstock assembly;

placing the first elongated body adjacent an end of the inner sidewall surfaces; and securing the first elongated body and the second elongated body together to form a pressure holding cavity defined by the first and second inner surfaces and the inner sidewall surfaces, wherein a length of the first elongated body extends from an upper longitudinal end to a lower longitudinal end of the second elongated body when coupled together.

17. The method of claim 16, wherein the ramped concave surface is a perforation plate.

18. The method of claim 17, wherein the ramped concave surface further comprises a guide rail for deflecting a milling bit away from the perforation plate.

19. The method of claim 17, further comprising providing one or more raised surfaces on the perforation plate for deflecting a milling bit away from the perforation plate.

20. The method of claim 17, further comprising securing one or more supports within the cavity to provide greater pressure capacity of the cavity.

21. The method of claim 16, wherein the ramped concave surface has a substantially uniform cross-sectional wall thickness along a substantial portion of its longitudinal length.

22. The method of claim 16, wherein the first elongated body has a cross-sectional wall thickness greater than the ramped concave surface of the second elongated body.

23. The method of claim 16, wherein the first and second elongated bodies include a connection edge disposed along the longitudinal length of each body.

24. The method of claim 23, further comprising aligning the connection edges to form an arcuate recess for receiving a weldment material to secure the first and second elongated bodies together to form the pressure holding cavity.

25. The method of claim 16, further comprising containing wellbore pressure from below the whipstock assembly and preventing migration of wellbore fluids upward through the whipstock assembly using the pressure holding cavity.

26. A method for creating a whipstock assembly, comprising:

providing a first member having a first elongated body with an outer surface and an opposite ramp surface;

providing a second member having a second elongated body with a ramped concave surface having a perforation plate, and an opposite cavity surface;

inserting the second member into the first member to locate the ramped concave surface proximate the opposite ramp surface thereby forming a cutting tool guide portion; and securing the first elongated body and the second elongated body together thereby forming a fluidly sealed pressure vessel between the first member and the second member.

27. The method of claim 26, wherein the cutting tool guide portion deflects a cutting tool away from contact with the perforation plate.

28. The method of claim 26, wherein the perforation plate includes a raised surface feature to direct a cutting tool along the ramped concave surface.

29. The method of claim 26, further comprising securing one or more supports to the first elongated body and the second elongated body to provide greater pressure capacity of the pressure vessel.

30. The method of claim 26, wherein the cutting tool guide portion extends above the pressure vessel to deflect a cutting tool away from the pressure vessel.

31. The method of claim 26, wherein the first member further includes a laterally extended portion disposed adjacent the first elongated body and operable to direct a cutting tool onto the cutting tool guide portion.

32. A whipstock assembly, comprising:

a first elongated body having an outer surface and an opposite inner surface;

a second elongated body having an outer concave surface, an opposite inner convex surface, and an inner sidewall surface extending from each side of the inner convex surface, wherein the outer concave surface is adapted to guide a milling tool, wherein the first and second bodies are elongated along an axial length of the whipstock assembly; and a connection edge configured to couple the bodies together such that the inner surfaces form a pressure holding cavity, wherein a length of the first elongated body extends from an upper longitudinal end to a lower longitudinal end of the second elongated body when coupled together.

33. The whipstock assembly of claim 32, wherein the pressure holding cavity is configured to contain wellbore pressure from below the whipstock assembly and prevent migration of wellbore fluids upward through the whipstock assembly.

34. A whipstock assembly, comprising:

a first elongated body having an outer surface and a first opposite cavity surface;

a second elongated body having a ramped concave surface and a second opposite cavity surface that forms a substantially U-shaped configuration facing away from the ramped concave surface, wherein the ramped concave surface is adapted to guide a milling tool, wherein the first and second bodies are elongated along an axial length of the whipstock assembly; and a connection edge configured to couple the bodies together such that the first and second cavity surfaces form a pressure holding cavity, wherein a length of the first elongated body extends from an upper longitudinal end to a lower longitudinal end of the second elongated body when coupled together.

35. The whipstock assembly of claim 34, wherein the pressure holding cavity is configured to contain wellbore pressure from below the whipstock assembly and prevent migration of wellbore fluids upward through the whipstock assembly.

36. A whipstock assembly, comprising:

a first elongated body having an outer surface and an inner surface; and a second elongated body having a ramped outer concave surface, an inner surface, and a sidewall surface extending from each side of the inner surface, wherein the ramped outer concave surface is adapted to guide a milling tool, wherein the first and second elongated bodies are elongated along an axial length of the whipstock assembly, wherein the bodies are coupled together such that the inner surfaces and the sidewall surfaces form a pressure holding cavity, and wherein the first elongated body has a cross-sectional wall thickness or shape that is different than a cross-sectional wall thickness or shape of the second elongated body at the same location along the axial length of the whipstock assembly.

* * * * *

UNITED STATES PATENT AND TRADEMARK OFFICE

CERTIFICATE OF CORRECTION

PATENT NO. : 8,245,774 B2
APPLICATION NO. : 12/099659
DATED : August 21, 2012
INVENTOR(S) : Carter et al.

It is certified that error appears in the above-identified patent and that said Letters Patent is hereby corrected as shown below:

Title Page, item 63, Related U.S. Application Data:

Please delete "Continuation of application No. 10/510,672, filed as application No. PCT/US03/11455 on Apr. 14, 2003, now Pat. No. 7,353,867." and insert --Continuation of application No. 10/510,672, filed on Aug. 23, 2005, now Pat. No. 7,353,867, which is a 371 application of PCT application No. PCT/US03/11455, filed on Apr. 14, 2003.-- therefor.

Signed and Sealed this
First Day of January, 2013

David J. Kappos

David J. Kappos
*Director of the United States Patent and Trademark Office*